US008993906B2

(12) United States Patent
Miyaoka

(10) Patent No.: US 8,993,906 B2
(45) Date of Patent: Mar. 31, 2015

(54) VEHICLE SWITCH

(71) Applicant: Panasonic Corporation, Osaka (JP)

(72) Inventor: Takeshi Miyaoka, Fukui (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 148 days.

(21) Appl. No.: 13/788,282

(22) Filed: Mar. 7, 2013

(65) Prior Publication Data

US 2013/0270077 A1 Oct. 17, 2013

(30) Foreign Application Priority Data

Apr. 12, 2012 (JP) ..... 2012-090765

(51) Int. Cl.
*H01H 3/16* (2006.01)
*H01H 1/44* (2006.01)

(52) U.S. Cl.
CPC . *H01H 3/161* (2013.01); *H01H 1/44* (2013.01)
USPC ..... 200/61.62

(58) Field of Classification Search
USPC ..... 200/61.62, 502, 510, 520, 538, 237, 200/321, 329, 341, 345
See application file for complete search history.

(56) References Cited

U.S. PATENT DOCUMENTS

2003/0034241 A1 * 2/2003 Kunthady et al. ..... 200/341
2007/0045090 A1 3/2007 Shiroshita

FOREIGN PATENT DOCUMENTS

JP 2007-87928 4/2007

* cited by examiner

*Primary Examiner* — Edwin A. Leon
*Assistant Examiner* — Anthony R. Jimenez
(74) *Attorney, Agent, or Firm* — Panasonic Patent Center

(57) ABSTRACT

A vehicle switch includes a case having an opening, an operation body, a mounting plate, a cover, a switch contact, and a spacer. The operation body is accommodated in the case, has an operation portion protruding from the opening, and moves in the direction perpendicular to the opening. The mounting plate is mounted on the periphery of the opening of the case. The cover covers the operation body and the mounting plate. The switch contact is housed in the case, and performs electric contact according to movement of the operation body. The spacer is disposed on at least the periphery of the opening on a surface that faces the cover of the mounting plate.

8 Claims, 9 Drawing Sheets

VEHICLE SWITCH

1. TECHNICAL FIELD

The present technical field relates to a vehicle switch mainly mounted on an automobile for detecting, for example, opening/closing of a door.

2. BACKGROUND ART

In recent years, vehicle switches mounted on door portions of an automobile to detect opening/closing of doors and to control, for example, turning-on of lighting in a vehicle have been developed. FIG. 6 is a sectional view of a conventional vehicle switch. FIG. 7 is an exploded perspective view of the conventional vehicle switch. Operation body 2 having operation portion 2A on the upper part thereof is housed movably up and down in case 1 having a substantially box-like shape with its upper surface opened. Operation body 2 and case 1 are both made of insulating resin.

Fixed contact 3 made of metal is attached to the right side surface in FIG. 6 inside case 1. A lower end of fixed contact 3 protrudes to the lower part of case 1.

Mounting plate 4 includes opening 4A, through hole 4B, mounting portion 4C, edge portion 4D, contact portion 4E, and a plurality of engagement portions 4F. Mounting plate 4 has an elliptical shape seen from the upper surface, and is made of metal. Mounting plate 4 is provided with opening 4A on the right side in FIG. 6. Mounting plate 4 is provided with flat mounting portion 4C on the left side thereof. Through hole 4B is formed in the left part of mounting portion 4C. Edge portion 4D is formed on a section that is higher by one step than the outer periphery of mounting portion 4C.

Contact portion 4E bent downward and extending toward the inside surface of case 1 is formed on a section that faces opening 4A of mounting plate 4 (that is, on the left inside of opening 4A). A plurality of engagement portions 4F are formed on a section of opening 4A in which contact portion 4E is not formed. Convex-shaped locking portion 1A formed on the inner side of case 1 is engaged with contact portion 4E, and a plurality of convex-shaped locking portions 11A formed on the outer side of case 1 are engaged with the plurality of engagement portions 4F. Thus, case 1 is mounted on mounting plate 4.

A central part of U-shaped movable contact 5 is mounted on a lower surface of operation body 2. Movable contact 5 is brought into elastic contact with contact portion 4E of mounting plate 4 and fixed contact 3 in a state in which left and right ends of movable contact 5 are slightly flexed. Thus, a switch contact is formed. Movable contact 5 is formed of a metal thin plate.

Coil spring 6 is mounted in a slightly contracted state between the inner bottom surface of case 1 and the lower surface of operation body 2. Spring 6 urges operation body 2 and movable contact 5 upward.

Mounting plate 4 is insert-molded on the lower surface of cover 7 made of, for example, rubber. Operation portion 2A of operation body 2 protrudes upward from an opening on the upper surface of case 1. Dome portion 7A in the right part of cover 7 covers operation portion 2A. Hollow cylindrical portion 7B is provided in the left part of cover 7. Thus, vehicle switch 11 is configured.

A lower end of fixed contact 3 protruding toward the bottom surface of case 1 is coupled to a room lamp or the like by lead wire (not shown) or the like via an electronic circuit (not shown) of an automobile. Vehicle switch 11 is attached to a chassis (not shown) of a vehicle body by, for example, a screw (not shown) that is allowed to pass through hollow cylindrical portion 7B and through hole 4B, and mounting plate 4 is grounded to the chassis. Thus, vehicle switch 11 is mounted on a door portion of a vehicle.

In the above-mentioned configuration, when the door of the automobile is opened, operation body 2 is urged upward by spring 6, and left and right ends of movable contact 5 mounted on operation body 2 are brought into elastic contact with contact portion 4E and fixed contact 3, respectively. Thus, contact portion 4E and fixed contact 3 are electrically connected to each other via movable contact 5. The electronic circuit of an automobile detects the electric connection, and, for example, turns on the room lamp.

FIG. 8 is a sectional view of a conventional vehicle switch during pressing operation. When a door is closed, pressing body 8 attached to the door presses operation portion 2A via an upper part of dome portion 7A of cover 7. Then, dome portion 7A is elastically deformed, and operation body 2 is shifted downward inside case 1 while it contracts spring 6.

Then, a left end of movable contact 5 mounted on operation body 2 is apart from contact portion 4E of mounting plate 4 and is brought into elastic contact with a left inside surface of case 1. Thus, contact portion 4E and fixed contact 3 are electrically disconnected from each other. The electronic circuit detects the electric disconnection, and, for example, turns off the room lamp.

Note here that in a state in which the door is closed, in general, pressing body 8 stops at a position in which operation body 2 is separated upward from an upper surface of cover 7 with a predetermined space. Therefore, a tip end of operation portion 2A of operation body 2 protrudes from the upper end of case 1 by a predetermined length, and a predetermined clearance is given between lower end portion 2B of operation body 2 and an inner bottom surface of case 1.

That is to say, by opening and closing operations of the door, operation body 2 of vehicle switch 11 mounted on the door portion of the vehicle is pressed and operated, electric connection and disconnection of the switch contact including movable contact 5, contact portion 4E and fixed contact 3 are carried out. Then, the electronic circuit of the vehicle detects the electric connection and disconnection, and carries out various controls such as turning on and off of the room lamp.

SUMMARY

A vehicle switch includes a case having an opening, an operation body, a mounting plate, a cover, a switch contact, and a spacer. The operation body is accommodated in the case, has an operation portion protruding from the opening, and moves in the direction perpendicular to the opening. The mounting plate is mounted on the periphery of the opening of the case. The cover covers the operation body and the mounting plate. The switch contact is housed in the case, and performs electric contact according to movement of the operation body. The spacer is disposed on at least the periphery of the opening on a surface that faces the cover of the mounting plate.

DETAILED DESCRIPTION

Figure 6:
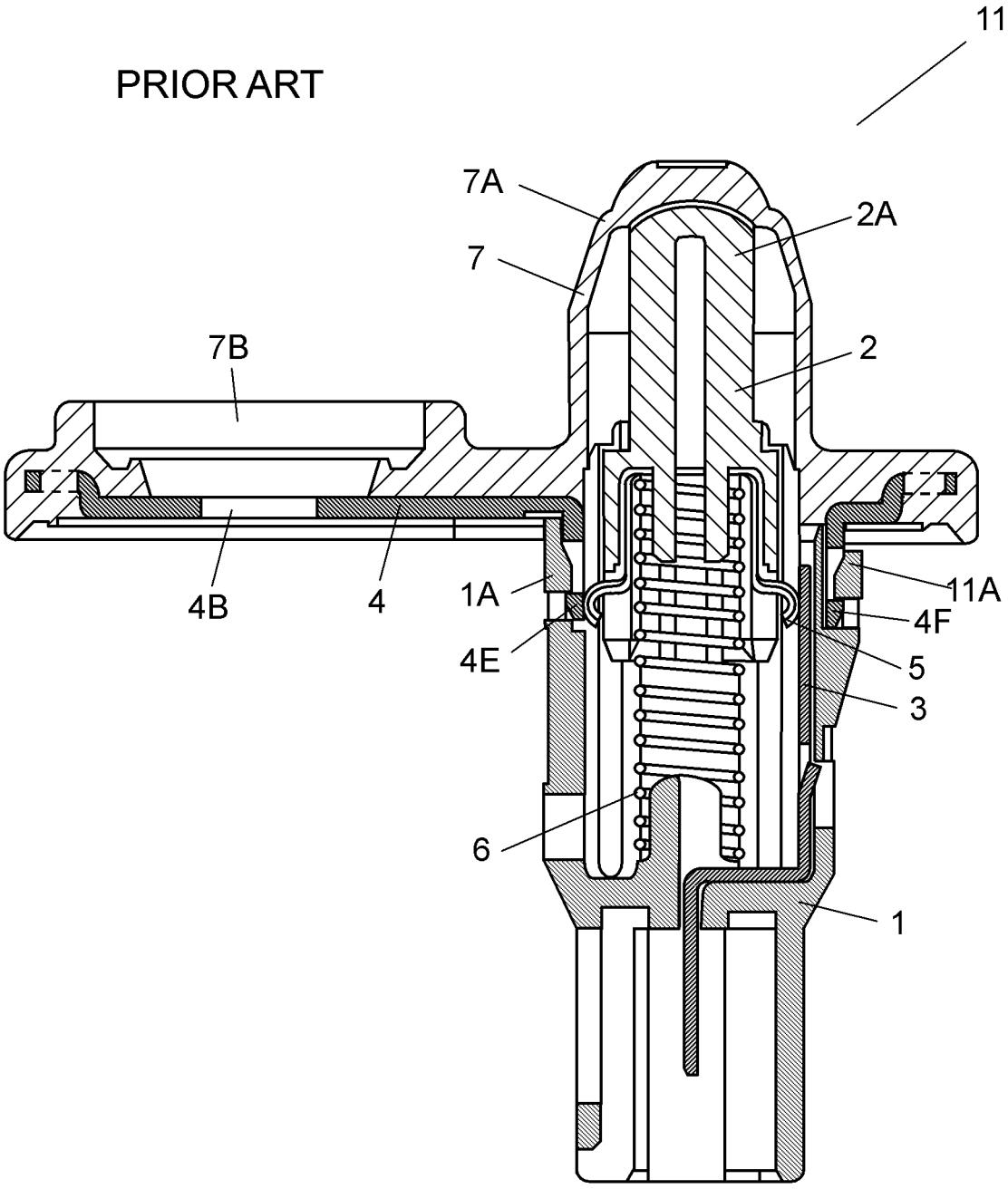
FIG. 6 PRIOR ART
FIG. 6 is a sectional view of a conventional vehicle switch.
Figure 7:
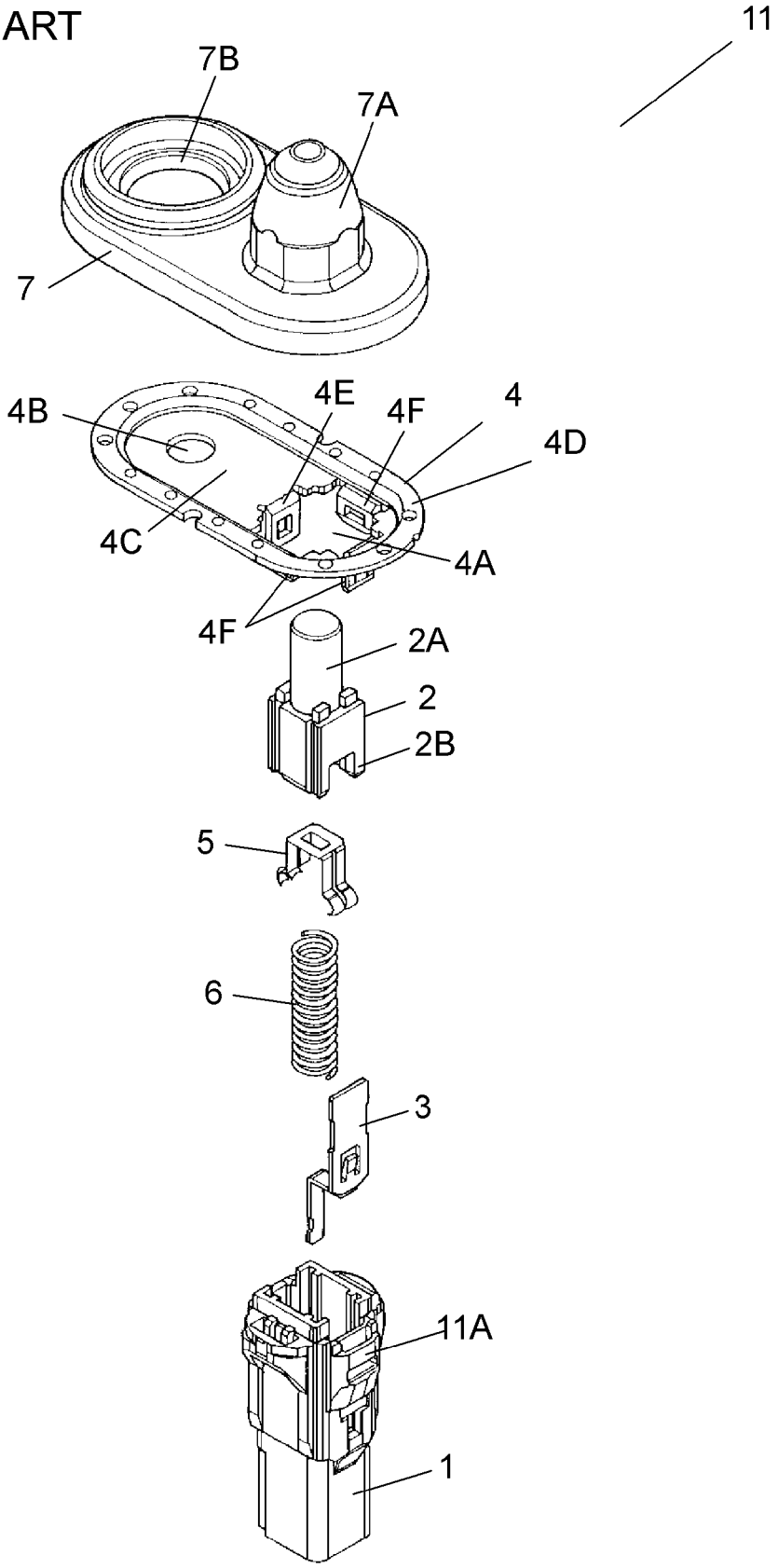
FIG. 7 PRIOR ART
FIG. 7 is an exploded perspective view of the conventional vehicle switch.
Figure 8:
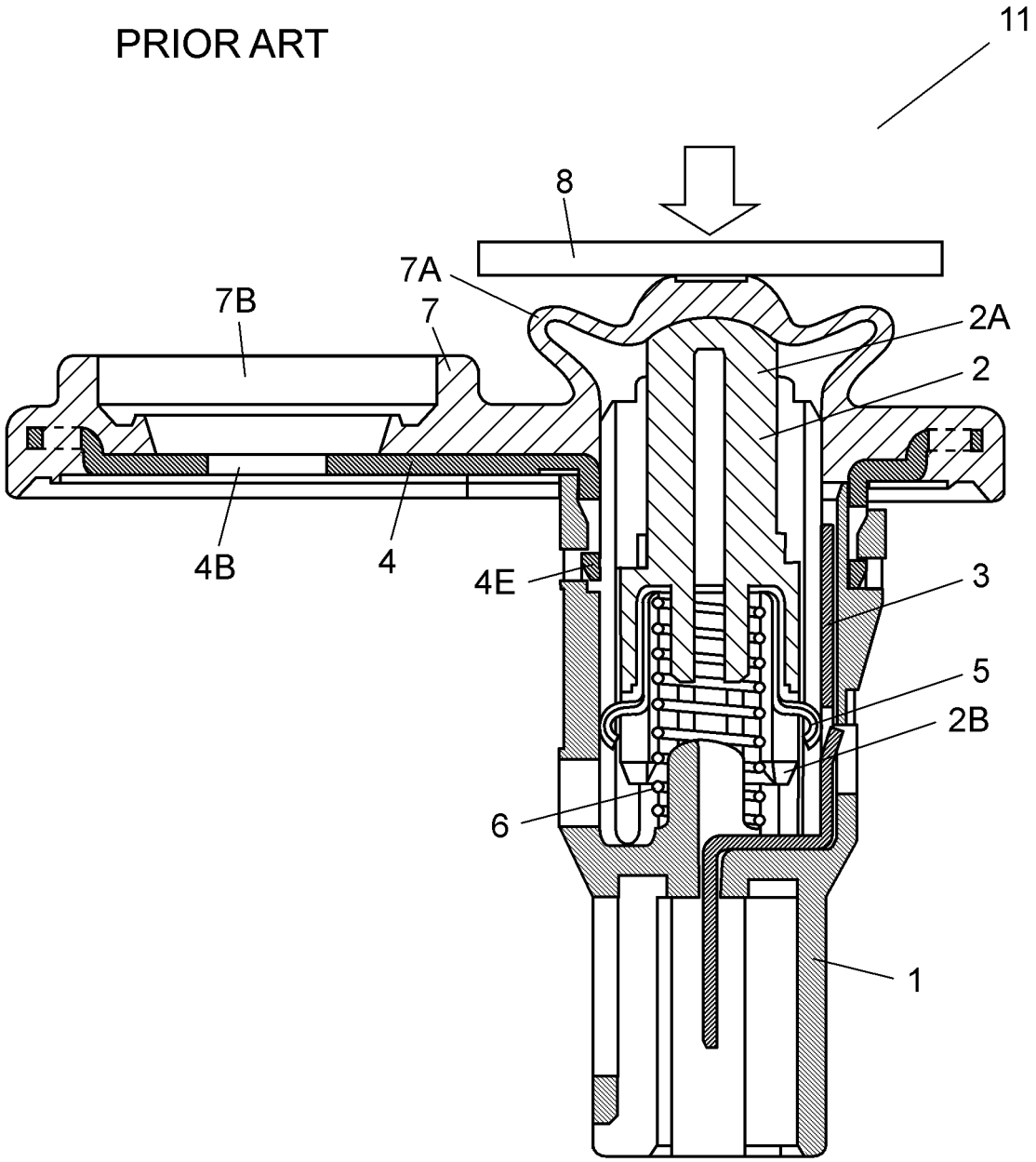
FIG. 8 PRIOR ART
FIG. 8 is a sectional view of the conventional vehicle switch during pressing operation.
Figure 9:
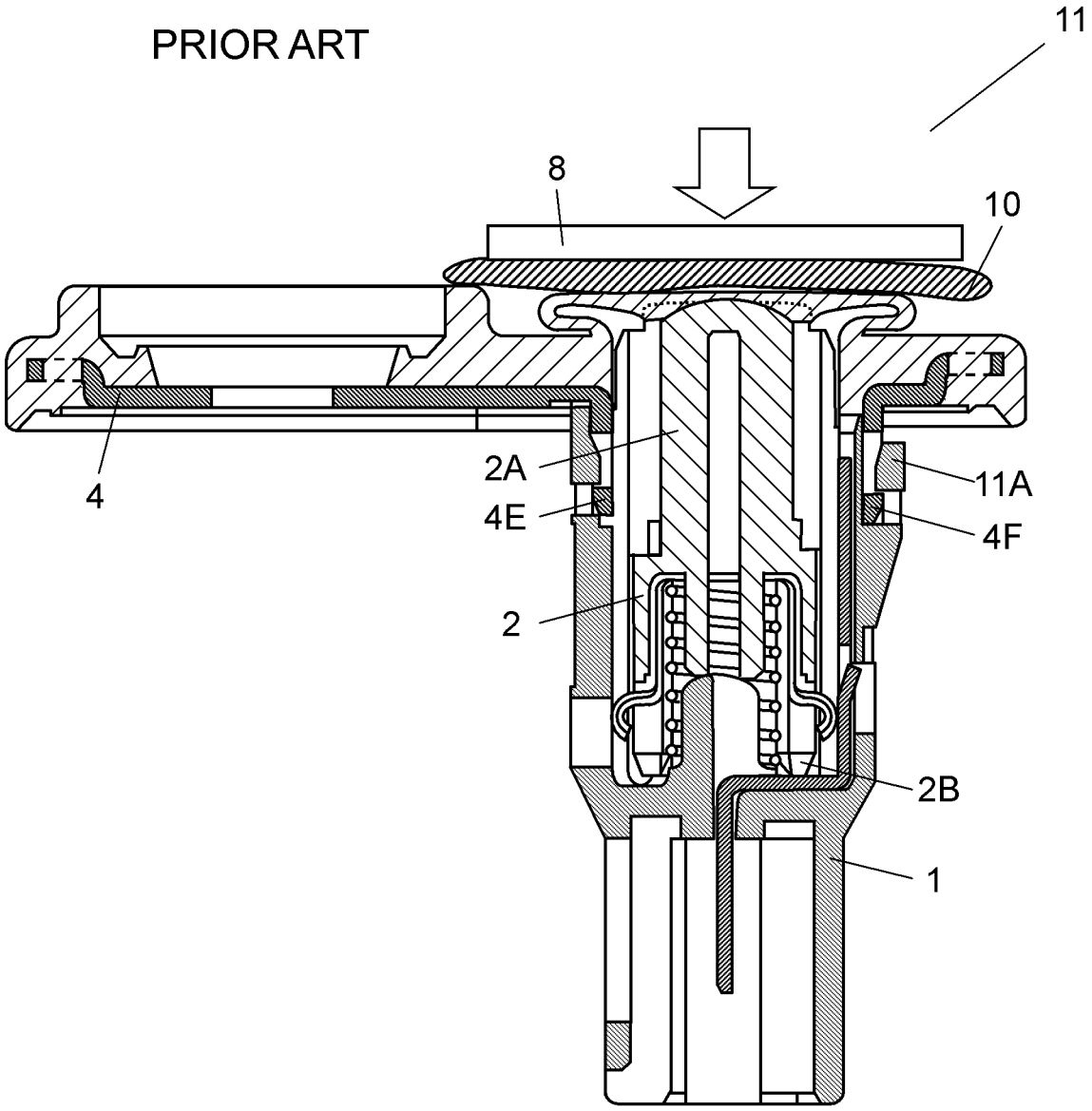
FIG. 9 PRIOR ART
FIG. 9 is a sectional view of the conventional vehicle switch during pressing operation.

FIG. 9 is a sectional view of a vehicle switch shown in FIG. 6 during pressing operation. In conventional vehicle switch 11, when foreign object 10 such as clothes is caught between pressing body 8 and vehicle switch 11 by mistake when a door is closed, operation body 2 is further pressed and shifted more downward than a usual operation position. As a result, lower end portion 2B of operation body 2 is brought into contact with the inner bottom surface of case 1, and presses case 1 with relatively large force. Therefore, backlash may be generated in engagement between contact portion 4E and engagement portions 4F of mounting plate 4 and locking portion 1A of case 1. As a result, when the door is opened and operation body 2 is shifted upward, contact between movable contact 5 and contact portion 4E or fixed contact 3 may be unstable.

Herein, when operation body 2 is made to be short, it is thought that lower end portion 2B is not easily brought into contact with the inner bottom surface of case 1. However, when operation body 2 moves up and down, a guide portion on the outside surface of operation body 2 slides on the inside surface of case 1. Consequently, when operation body 2 becomes short, contact between the guide portion on the outside surface of operation body 2 and the inside surface of case 1 may be unstable, and operation may be difficult to be done Hereinafter, this embodiment is described with reference to FIGS. 1 to 5.

Figure 1:
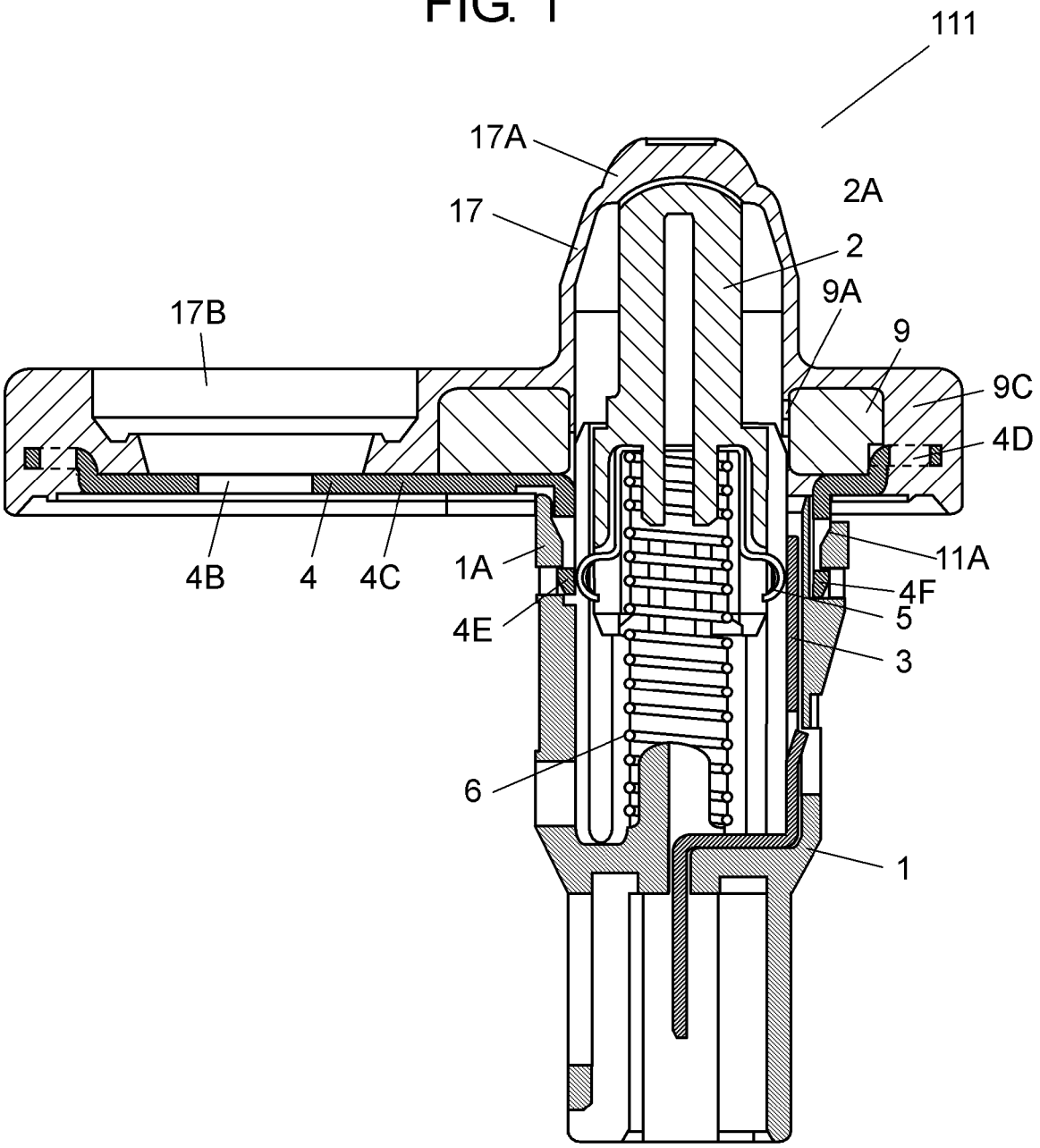
FIG. 1 is a sectional view of a vehicle switch in accordance with an embodiment.
Figure 2:
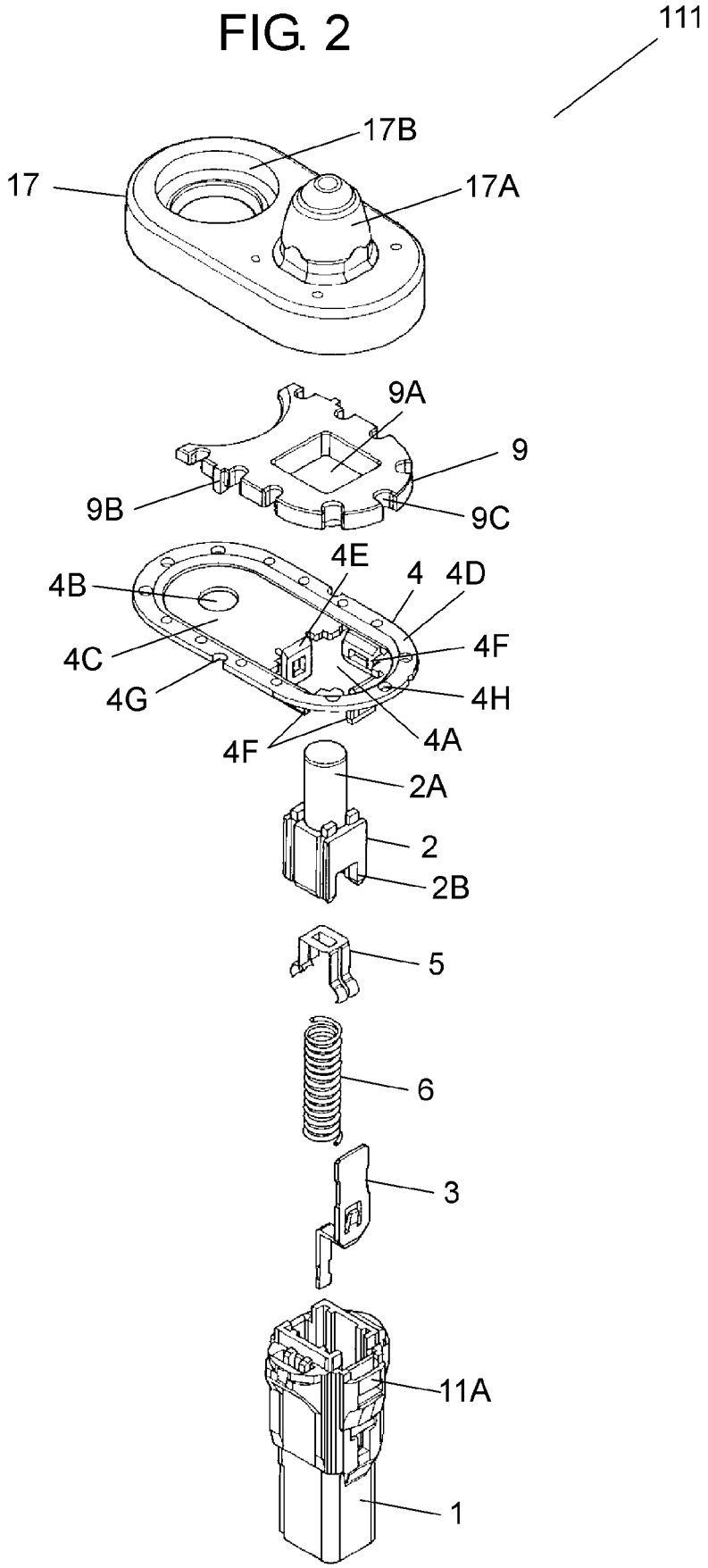
FIG. 2 is an exploded perspective view of the vehicle switch in accordance with this embodiment.
Figure 3:
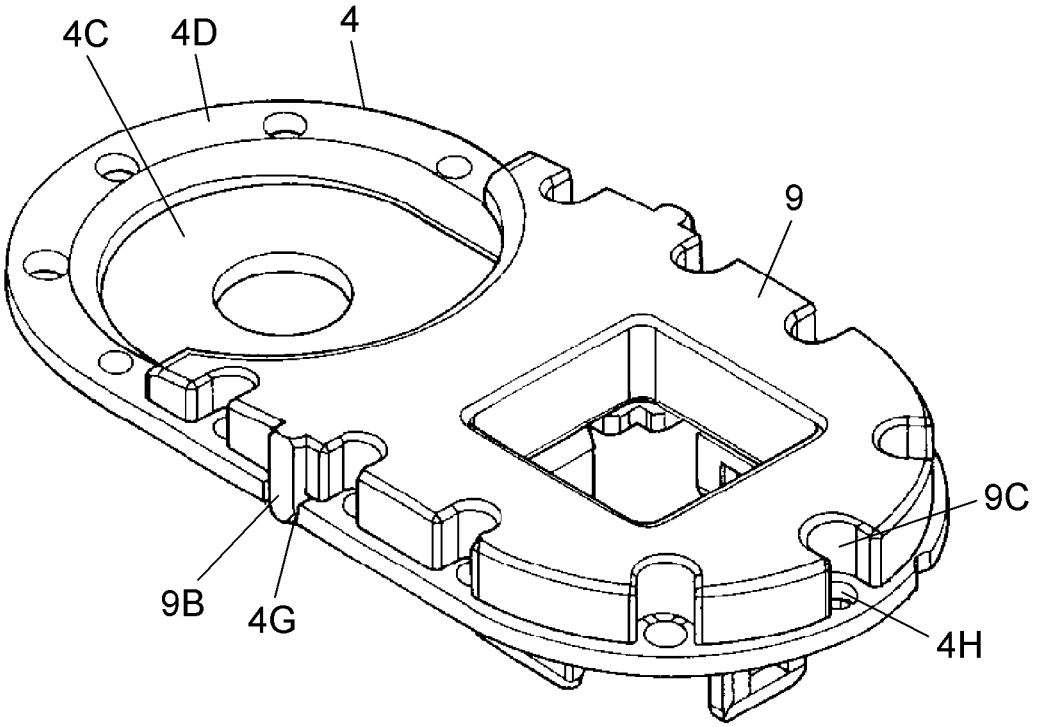
FIG. 3 is a perspective view of a principal part of the vehicle switch in accordance with this embodiment.

FIG. 1 is a sectional view of a vehicle switch in accordance with an embodiment. FIG. 2 is an exploded perspective view of the vehicle switch in accordance with this embodiment. FIG. 3 is a perspective view of a principal part of the vehicle switch in accordance with this embodiment.

Vehicle switch 111 includes case 1 having an opening, operation body 2, mounting plate 4, cover 17, a switch contact, and spacer 9. Operation body 2 is accommodated in case 1, has operation portion 2A protruding from the opening, and moves in the direction perpendicular to the opening. Mounting plate 4 is mounted on the periphery of the opening of case 1. Cover 17 covers operation body 2 and mounting plate 4. The switch contact is housed in case 1, and performs electric contact according to movement of operation body 2. Spacer 9 is disposed on at least the periphery of the opening on a surface that faces cover 17 of mounting plate 4. The switch contact includes movable contact 5, contact portion 4E, and fixed contact 3.

Operation body 2 is accommodated movably up and down in case 1 having a substantially box-like shape with its upper surface opened. Operation portion 2A in the upper part of operation body 2 protrudes upward from an opening of case 1. Fixed contact 3 made of metal such as copper alloy is attached to the right side surface in FIG. 1 inside case 1. A lower end of fixed contact 3 protrudes to the lower part of case 1. Case 1 is made of insulating resin such as polyoxymethylene. Operation body 2 is made of insulating resin such as polybutylene terephthalate.

Mounting plate 4 includes opening 4A, through hole 4B, mounting portion 4C, edge portion 4D, contact portion 4E, and a plurality of engagement portions 4F. Mounting plate 4 has an elliptical shape seen from the upper surface, and is made of metal such as steel and copper alloy. Mounting plate 4 is provided with opening 4A on the right side in FIG. 1. Mounting plate 4 is provided with flat mounting portion 4C on the left side. Through hole 4B is formed in the left part of mounting portion 4C. Edge portion 4D is formed on a section that is higher by one step from the outer periphery of mounting portion 4C.

Contact portion 4E bent downward and extending toward the inside surface of case 1 is formed on a section that faces opening 4A of mounting plate 4 (that is, on the left inside of opening 4A). A plurality of engagement portions 4F are formed on a section of opening 4A in which contact portion 4E is not formed. Convex-shaped locking portion 1A formed on the inner side of case 1 is engaged with contact portion 4E, and a plurality of convex-shaped locking portions 11A formed on the outer side of case 1 are engaged with the plurality of engagement portions 4F. Thus, case 1 is mounted on mounting plate 4.

A central part of U-shaped movable contact 5 is mounted on a lower surface of operation body 2. Movable contact 5 is brought into elastic contact with contact portion 4E of mounting plate 4 and fixed contact 3 in a state in which left and right ends of movable contact 5 are slightly flexed. Thus, a switch contact is formed. Movable contact 5 is formed of a metal thin plate of, for example, copper alloy.

Coil spring 6 is mounted in a slightly contracted state between the inner bottom surface of case 1 and the lower surface of operation body 2. Spring 6 urges operation body 2 and movable contact 5 upward. Spring 6 is formed of steel wire, copper alloy wire, or the like.

Quadrangular insertion hole 9A is formed in substantially the middle of flat-shaped spacer 9. Spacer 9 is placed on mounting portion 4C and edge portion 4D of mounting plate 4 such that insertion hole 9A surrounds the outer periphery of case 1. Spacer 9 is made of insulating resin such as polypropylene. The thickness of spacer 9 is set such that a clearance is given between lower end portion 2B of operation body 2 and an inner bottom surface of case 1 when operation body 2 moves downward and an upper end of operation portion 2A and an upper surface of spacer 9 match with each other in position.

Furthermore, positioning part 9B that protrudes downward from space 9 is engaged with cut-away portion 4G formed in edge portion 4D of mounting plate 4.

A plurality of run-through holes 4H are provided in edge portion 4D of mounting plate 4 at predetermined intervals. The outer periphery of spacer 9 is provided with hole-shaped recesses or U-shaped cut-away portions 9C, each of which is formed so as to surround the vicinity of the outer periphery of each of run-through holes 4H.

Spacer 9 and mounting plate 4 are disposed on the lower surface of cover 17, and spacer 9, mounting plate 4, and cover 17 are formed integrally with each other by insert molding. Cover 17 is made of, for example, olefin thermoplastic elastomer having elasticity.

Note here that when cover 17 is formed integrally with mounting plate 4 and spacer 9, as shown in FIG. 3, positioning part 9B of spacer 9 is engaged with cut-away portion 4G of mounting plate 4, and cover 17 is insert-molded by injection molding in a state in which spacer 9 is placed on an upper surface of mounting plate 4. Note here that spacer 9 and mounting plate 4 may be formed integrally by insert molding, and then cover 17 may be integrally formed onto the integrally formed spacer 9 and mounting plate 4.

At this time, resin such as injected elastomer is filled also in a plurality of cut-away portions 9C of spacer 9, and run-through holes 4H in the lower part and the entire outer periphery of the lower surface of mounting plate 4, so that cover 17 is formed integrally.

In this way, cover 17 adheres to mounting plate 4 and spacer 9. Furthermore, since mounting plate 4 and spacer 9 are coupled to cover 17 via the plurality of cut-away portions 9C, mounting plate 4 and spacer 9 and cover 17 are not easily displaced or detached from each other, so that they are strongly connected to each other.

Operation portion 2A of operation body 2 protrudes upward from the opening on the upper surface of case 1. Dome portion 17A in the right part of cover 17 covers operation portion 2A. In the left part of cover 17, hollow cylindrical portion 17B whose upper end surface is on substantially the same plane as the surface of the periphery of the dome portion 17A is provided. Thus, vehicle switch 111 is configured. A lower end of fixed contact 3 protruding toward the right bottom surface of case 1 is coupled to a room lamp or the like by lead wire (not shown) or the like via an electronic circuit (not shown) of an automobile. Vehicle switch 111 is attached to a chassis (not shown) of a vehicle body by, for example, a screw (not shown) that is allowed to pass through hollow cylindrical portion 17B and through hole 4B, and mounting plate 4 is grounded to the chassis. Thus, vehicle switch 111 is mounted on the door portion of the vehicle.

In the above-mentioned configuration, when the door of the automobile is opened, operation body 2 is urged upward by spring 6, and left and right ends of movable contact 5 mounted on operation body 2 are brought into elastic contact with contact portion 4E and fixed contact 3, respectively. Therefore, contact portion 4E and fixed contact 3 are electrically connected to each other via movable contact 5. The electronic circuit of an automobile detects the electric connection, and, for example, turns on the room lamp.

Figure 4:
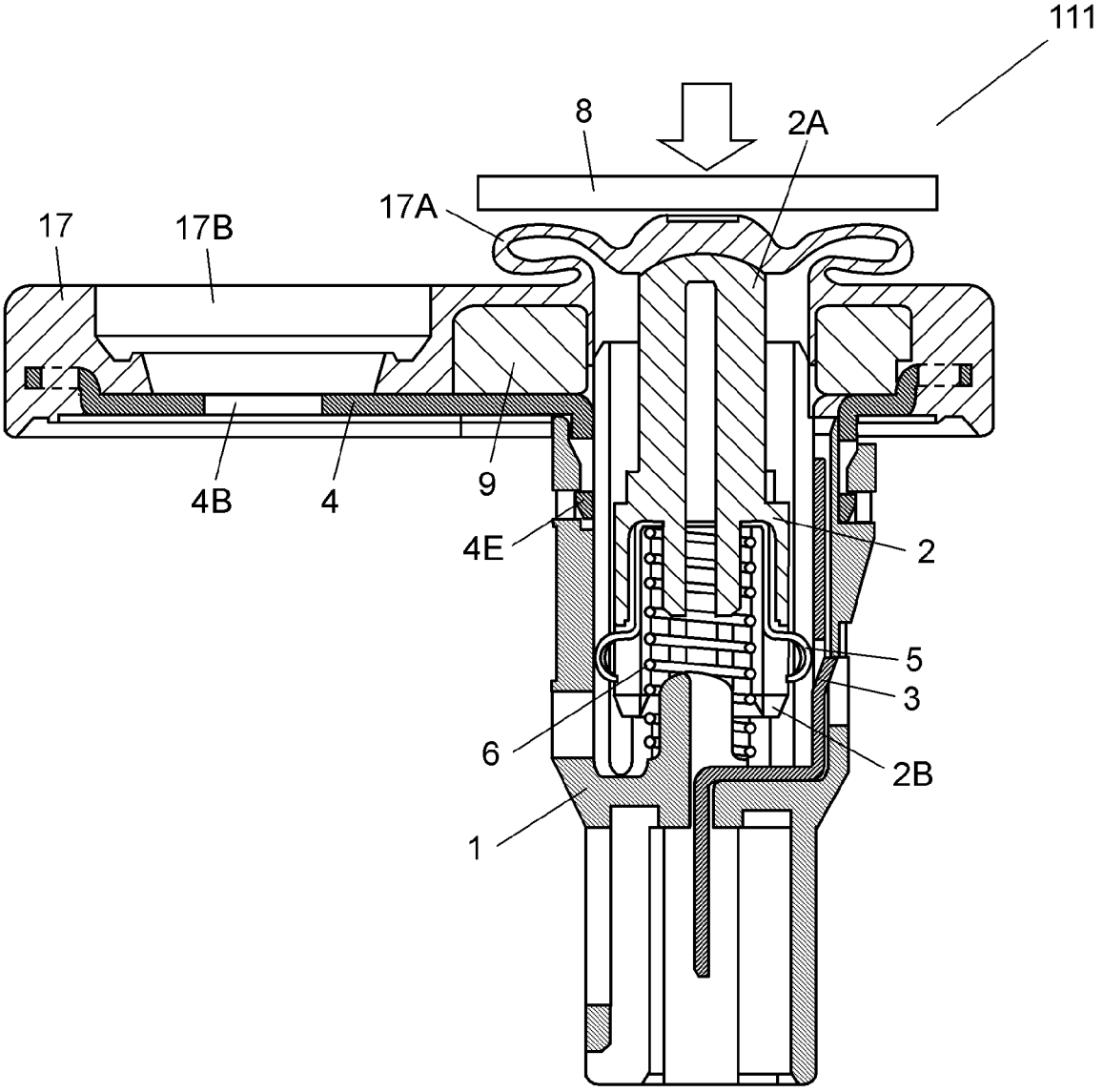
FIG. 4 is a sectional view of the vehicle switch during pressing operation in accordance with this embodiment.

FIG. 4 is a sectional view of vehicle switch 111 shown in FIG. 1 during pressing operation. When the door is closed, pressing body 8 attached to the door presses operation portion 2A via an upper part of dome portion 17A of cover 17. Then, dome portion 17A is elastically deformed, and operation body 2 is shifted downward inside case 1 while it contracts spring 6.

Then, a left end of movable contact 5 mounted on operation body 2 is apart from contact portion 4E of mounting plate 4 and is brought into elastic contact with a left inside surface of case 1, and contact portion 4E and fixed contact 3 are electrically disconnected from each other. The electronic circuit detects the electric disconnection, and, for example, turns off a room lamp.

That is to say, by opening/closing operation of the door, operation body 2 of vehicle switch 111 mounted on the door portion of the vehicle is pressed and operated, and operation body 2 moves up and down. Thus, electric connection and disconnection of the switch contact including movable contact 5, contact portion 4E and fixed contact 3 are performed. Then, the electronic circuit of the vehicle detects the electric connection and disconnection, and controls turning on and off of a room lamp.

In a state in which the door is closed, pressing body 8 stops at a position in which operation body 2 is separated upward from an upper surface of cover 17 on the periphery of dome portion 17A with a predetermined space. A tip end of operation portion 2A of operation body 2 protrudes from an opening of the upper end of case 1 by a predetermined length. Then, a predetermined clearance is kept between lower end portion 2B and the inner bottom surface of case 1.

Figure 5:
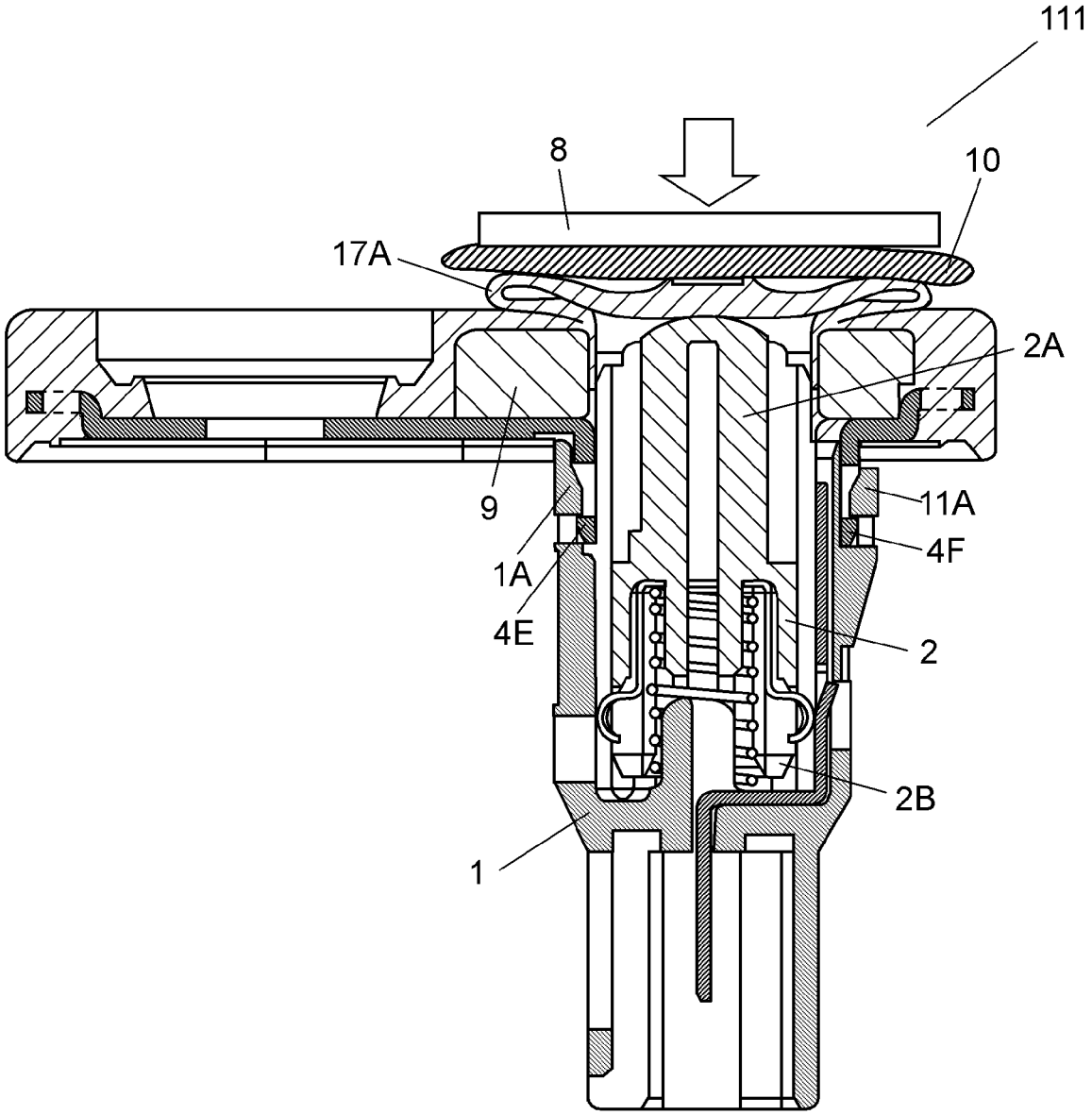
FIG. 5 is a sectional view of the vehicle switch during pressing operation in accordance with this embodiment.

Furthermore, as shown in the sectional view of FIG. 5, when for example, foreign object 10 such as clothes is caught between pressing body 8 and vehicle switch 111 by mistake when a door is closed, a tip end of operation portion 2A is pressed down to the vicinity of the upper surface of spacer 9 via dome portion 17A. However, with spacer 9, the tip end of operation portion 2A is not pressed down from spacer 9.

Therefore, even if pressing body 8 presses operation body 2 excessively via foreign object 10 or dome portion 17A, lower end portion 2B of operation body 2 is not brought into contact with the inner bottom surface of case 1. Consequently, reliable operations are possible.

That is to say, when the door is closed, in general, since pressing body 8 allows operation body 2 to shift downward to a predetermined position, a switch contact becomes in an electrically non-contact state. Then, when a door is closed in a state in which foreign object 10 such as clothes is caught by mistake, pressing body 8, foreign object 10, or the like, stops on the upper surface of spacer 9 via dome portion 17A. Therefore, operation body 2 is not pressed further downward. As a result, since lower end portion 2B of operation body 2 is not brought into contact with the inner bottom surface of case 1, backlash does not easily occur in engagement between contact portion 4E and engagement portion 4F of mounting plate 4 and locking portion 1A of case 1.

In this way, according to this embodiment, by disposing spacer 9 having a predetermined thickness on the upper surface of mounting plate 4 in the vicinity of the outer periphery of operation body 2, the tip end of operation portion 2A of operation body 2 stops on the upper surface of spacer 9. Consequently, shift of operation body 2 downward is regulated, and operation body 2 is not pressed downward from the predetermined position. As a result, reliable operation of vehicle switch 111 is achieved.

A vehicle switch according to this embodiment has an advantageous effect that reliable operation can be carried out, and is useful mainly for detecting, for example, opening/closing operation of a door in an automobile.

What is claimed is:

1. A vehicle switch comprising:

a case having an opening;

an operation body which is accommodated in the case, has an operation portion protruding from the opening, and moves up and down between an uppermost position and a downward position in a direction perpendicular to the opening;

a mounting plate mounted on a periphery of the opening of the case;

a cover for covering the operation body and the mounting plate;

a switch contact which is housed in the case and performs electric contact according to movement of the operation body; and a spacer disposed at least on the periphery of the opening of a surface that faces the cover of the mounting plat, wherein the spacer is made of insulating resin, and wherein a thickness of the spacer is set such that a clearance is given between a lower end portion of the operation body and an inner bottom surface of the case when the operation body moves downward and an upper end of the operation portion and an upper surface of the spacer match with each other in position.

2. The vehicle switch of claim 1, wherein the spacer has a flat shape and has an insertion hole through which the operation portion is allowed to pass.

3. The vehicle switch of claim 1, wherein the spacer is made of polypropylene.

4. The vehicle switch of claim 1, wherein the spacer and the mounting plate are formed integrally by insert molding.

5. The vehicle switch of claim 1, wherein the spacer, the mounting plate, and the cover are formed integrally by insert molding.

6. The vehicle switch of claim 1, wherein the switch contact includes:

a movable contact which is provided between a lower surface of the operation body and a bottom part of the case and moves according to the movement of the operation body;

a contact portion protruding from the mounting plate into the case; and a fixed contact provided in the case.

7. The vehicle switch of claim 1, wherein the spacer includes a positioning part protruding downward from the spacer and the positioning part is engaged with a cut-away portion formed in an edge portion of the mounting plate.

8. A vehicle switch comprising:

a case having an opening;

an operation body which is accommodated in the case, has an operation portion protruding from the opening, and moves up and down between an uppermost position and a downward position in a direction perpendicular to the opening;

a mounting plate mounted on a periphery of the opening of the case;

a cover for covering the operation body and the mounting plate;

a switch contact which is housed in the case and performs electric contact according to movement of the operation body; and a spacer disposed at least on the periphery of the opening of a surface that faces the cover of the mounting plate, wherein the spacer is made of insulating resin, and wherein when the operation body is placed at the uppermost position, a distance between a lower end portion of the operation body and an inner bottom surface of the case is larger than a distance between an upper end portion of the operation body and an upper surface of the spacer.

* * * * *